US007131548B2

(12) United States Patent
Hinrichs et al.

(10) Patent No.: US 7,131,548 B2
(45) Date of Patent: Nov. 7, 2006

(54) FOLDING PINNACLE BENDING DEVICE

(75) Inventors: Jan Hinrichs, Schortena (DE); Dieter Stuhrwoldt, Wilhelmshaven (DE)

(73) Assignee: Grove U.S. LLC, Shady Grove, PA (US)

( * ) Notice: Subject to any disclaimer, the term of this patent is extended or adjusted under 35 U.S.C. 154(b) by 213 days.

(21) Appl. No.: 10/827,242

(22) Filed: Apr. 20, 2004

(65) Prior Publication Data

US 2005/0011850 A1 Jan. 20, 2005

(30) Foreign Application Priority Data

May 13, 2003 (DE) ..... 103 21 493

(51) Int. Cl.
*B66C 23/42* (2006.01)

(52) U.S. Cl. ..... 212/168; 212/300

(58) Field of Classification Search ..... 212/168, 212/292, 300

See application file for complete search history.

(56) References Cited

U.S. PATENT DOCUMENTS

| | | | | | |
|---|---|---|---|---|---|
| 2,147,313 | A | * | 2/1939 | Payson | 212/200 |
| 2,198,793 | A | * | 4/1940 | Schroeder | 212/292 |
| 2,512,150 | A | * | 6/1950 | Geren | 92/18 |
| 3,085,695 | A | * | 4/1963 | Miller | 212/300 |
| 3,092,261 | A | * | 6/1963 | Nesbit | 212/292 |
| 3,638,804 | A | * | 2/1972 | Blakeway et al. | 212/285 |
| 3,754,666 | A | * | 8/1973 | Suverkrop | 212/300 |
| 3,899,089 | A | * | 8/1975 | Wardlaw | 414/543 |
| 4,484,686 | A | * | 11/1984 | Mentzer | 212/300 |
| 4,621,742 | A | * | 11/1986 | Rathi | 212/177 |
| 4,923,071 | A | * | 5/1990 | Koizumi | 212/347 |
| 4,953,724 | A | * | 9/1990 | Koizumi | 212/300 |
| 5,115,925 | A | * | 5/1992 | Koizumi | 212/347 |
| 5,135,118 | A | * | 8/1992 | Koizumi | 212/300 |
| 5,758,785 | A | * | 6/1998 | Spinosa et al. | 212/300 |
| 6,655,539 | B1 | * | 12/2003 | Bertinotti | 212/300 |

FOREIGN PATENT DOCUMENTS

| | | | |
|---|---|---|---|
| DE | 25 52 112 A1 | | 6/1976 |
| DE | 29 40 850 A1 | * | 7/1980 |
| DE | 291 531 A5 | | 7/1991 |
| DE | 93 18 480.8 | | 4/1994 |
| GB | 1 486 359 | | 9/1977 |
| SU | 619588 | * | 8/1978 |

* cited by examiner

*Primary Examiner*—Thomas J. Brahan
(74) *Attorney, Agent, or Firm*—Birch, Stewart, Kolasch & Birch, LLP

(57) ABSTRACT

A folding pinnacle bending device for a mobile crane (20) comprises a joint area (9) which is bent in order to adjust the angle of the folding pinnacle (10) and which comprises a joint (8) in its upper or tensile load area, wherein the joint area (9) comprises a mechanically fixable telescoping means (7) in its lower or pressure load area.

15 Claims, 4 Drawing Sheets

FOLDING PINNACLE BENDING DEVICE

CROSS-REFERENCE TO RELATED APPLICATION

This Nonprovisional application claims priority under 35 U.S.C. § 119(a) on Patent Application No(s). 103 21 493.2 filed in Germany on May 13, 2003, the entire contents of which are hereby incorporated by reference.

BACKGROUND OF THE INVENTION

1. Field of the Invention

The present invention relates to a folding pinnacle bending device for a mobile crane. Such folding pinnacles serve as jib extensions on mobile cranes. In order to obtain a greater overhang—for example, over the edges of buildings—for the same size of crane, it is necessary to bend the folding pinnacle. Such an application is shown in the enclosed FIG. 1. In order to be able to operate over the upper edge of the high-rise building 30, the mobile crane 20 bears a folding pinnacle 10 which is fastened to its outermost section and can be bent by means of a bending device 9, such that an overhang over the edge of the building is made possible.

2. Description of Related Art

In the prior art, two different types of folding pinnacle bending devices are known. These are mechanically adjustable rods in the upper or tensile load area of the of the joint area on the one hand, and hydraulic cylinder bending devices in the lower or pressure area of the joint area on the other.

FIG. 2 shows a bending device in accordance with the prior art, comprising a hydraulic cylinder 17 in the lower pressure load area of the joint area 9'. The hydraulic cylinder 17 is controlled by supplying and venting a hydraulic fluid and is thus altered in length. This has the advantage that the angle can be adjusted from the crane cabin in all positions of the main jib. Disadvantageously, however, high manufacturing costs are incurred, which are not always acceptable.

FIG. 3 shows the "mechanical solution" in accordance with the prior art, in which mechanically adjustable rods 16 are provided in the joint area 9", specifically in the upper tensile load area. The disadvantage of such a construction is that it cannot replace the hydraulic cylinder version (FIG. 2) without major alterations. The present invention provides a folding pinnacle bending device which avoids the disadvantages of the prior art highlighted above. In particular, the intention is to ensure that the basic construction of hydraulically bendable pinnacles can be used to provide a cost-effective pinnacle to be adjusted mechanically within a short period of time. Furthermore, the intention is to enable adjusting measures for the angle of the folding pinnacle to be performed easily and safely.

SUMMARY OF THE INVENTION

One aspect of the present invention is to provide folding pinnacle bending device for a mobile crane, comprising a joint area which is bent in order to adjust the angle of the folding pinnacle and which comprises a joint in its upper or tensile load area, the advantages in accordance with the invention are based on the fact that the joint area comprises a mechanically fixable telescoping means in its lower or pressure load area. In other words, as opposed to the hydraulic cylinder, a non-hydraulic telescoping means is provided in this case, which includes only means which are suitable for mechanically adjusting and fixing it to desired lengths. On the one hand, such a solution offers a relatively cost-effective alternative, since the costs for expensive hydraulic cylinders, for the hydraulic supply and the control and monitoring devices can be spared. On the other hand, such an expensive hydraulic cylinder can easily be replaced by a mechanically fixable telescoping means installed in the lower or pressure load area of the joint area, such that all the steel components of the hydraulically bendable pinnacle can be used and a cost-effective, purely mechanically adjustable folding pinnacle can be provided without too great an outlay, by using a lot of identical parts.

In an embodiment of the invention, the telescoping means comprises a telescopic pipe. The telescoping means or telescopic pipe can advantageously comprise support elements, by means of which it can be mechanically fixed at different lengths.

In one embodiment variant, the telescoping means or telescopic pipe comprises a holding element and an extending element. The holding element is fastened by a joint to the side of the joint area facing the base of the folding pinnacle, and the extending element is fastened by a joint to the side of the joint area facing the tip of the folding pinnacle. Thus, the same fastenings are used in the lower or pressure load area as with hydraulic cylinders, which makes replacing the hydraulic cylinder—as already mentioned above—easily possible. The support elements for the extending element can be arranged on the holding element.

In the lower or pressure load area, the telescoping means merely has to be configured such that it supports the upper portion, bent against the base of the folding pinnacle. It is sufficient to support the upper portion, it need not necessarily be fixed in both directions, i.e., the upper portion of the folding pinnacle is sufficiently fixed if a support against a further reduction in the angle of the folding pinnacle is provided on one side. This then results in the advantage that the final angle of the folding pinnacle can be set while it is still on the ground, if the jib as a whole—including the folding pinnacle—is placed very near above the ground. In this state, the selected support element is installed, the joint area being low above the ground, to avoid the danger of accidents. Only when the jib is raised is the telescoping means shifted, until the support element blocks and sets a particular angle. It is thus possible to simply and safely set the angle of the folding pinnacle in advance, on the ground.

In accordance with an embodiment of the invention, the fastening of the holding element to the side of the joint area facing the base of the folding pinnacle forms one of the support devices. This component can thus be used in two ways, ensuring on the one hand that the joint is fastened and on the other that the largest angle of the folding pinnacle which can be pre-set is counterheld.

The telescoping means advantageously comprises a round or cornered base pipe (as the holding element) and an extending piston (as the extending element), wherein the base pipe comprises transverse bores for receiving support bolts which support the piston at its lower end.

It is further possible, in a construction comprising a base pipe and an extending piston, to provide lateral inserts on the base pipe which serve to guide the piston, also said lateral inserts can form hubs for the transverse bores and so in turn fulfil two functions. The telescoping means advantageously comprises a securing device which prevents its telescopic components from detaching from each other. Said securing device can in particular be a distancing sleeve which is arranged between the lower, supporting end of the extending element and the upper end of the holding element and can serve as a recoil securing device. This securing device or distancing sleeve preferably defines the maximum length of the telescoping means.

BRIEF DESCRIPTION OF THE DRAWINGS

The features of the present invention here described can be employed, individually and in any combination, in various embodiments. In the following, a preferred embodiment is explained in more detail on the basis of the enclosed drawings, which show.

DETAILED DESCRIPTION OF THE INVENTION

Figure 2:
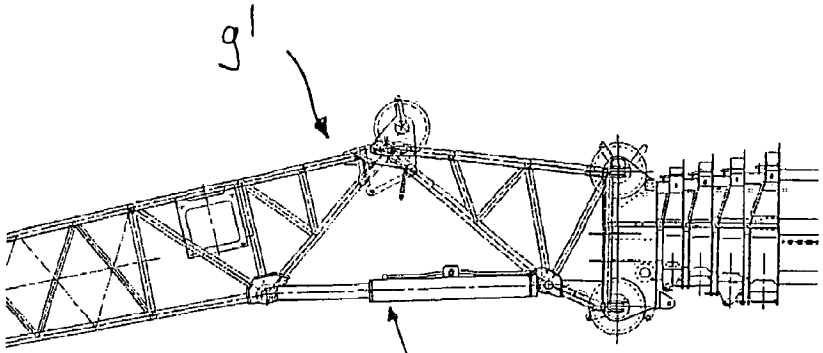
Figure 2 (prior art)
FIG. 2 a joint area for a folding pinnacle in accordance with the prior art, comprising a hydraulic cylinder.
Figure 3:
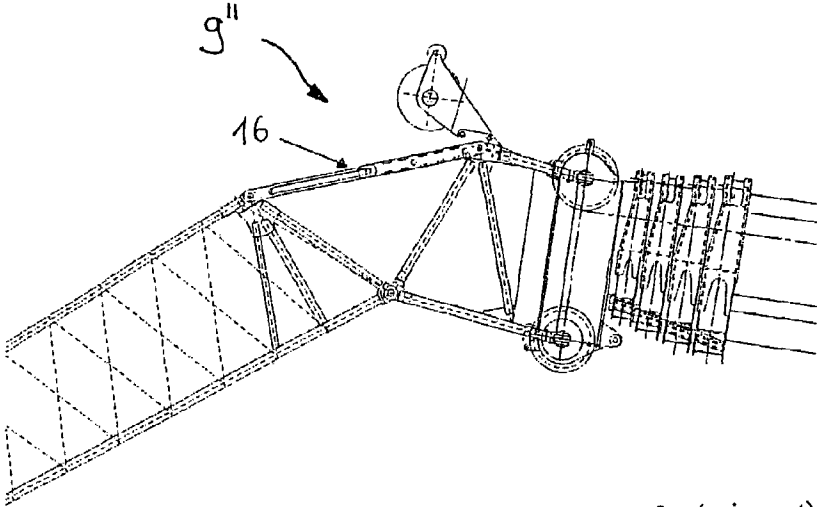
Figure 3 (prior art)
FIG. 3 a joint area for a folding pinnacle in accordance with the prior art, comprising a rod adjustment.
Figure 1:
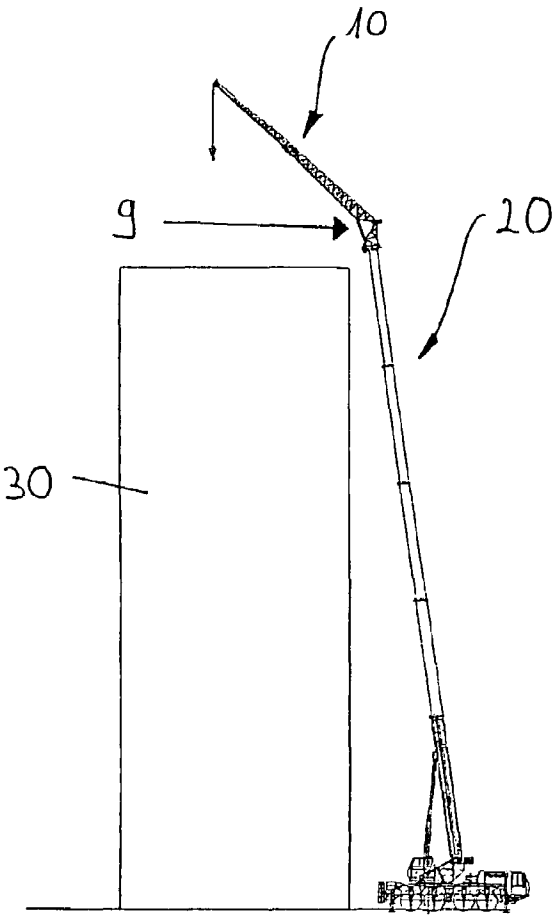
FIG. 1 a mobile crane, comprising a folding pinnacle over a high-rise building.
Figure 4:
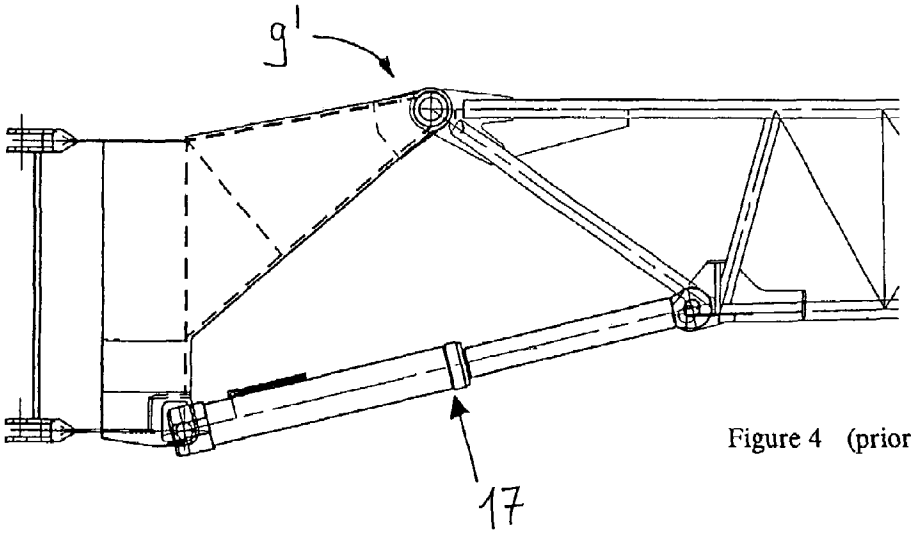
Figure 4 (prior art)
FIGS. 4 and 5 a comparison of a joint area comprising a hydraulic cylinder in accordance with the prior art and a joint area comprising a telescopic pipe in accordance with the present invention.
Figure 5:
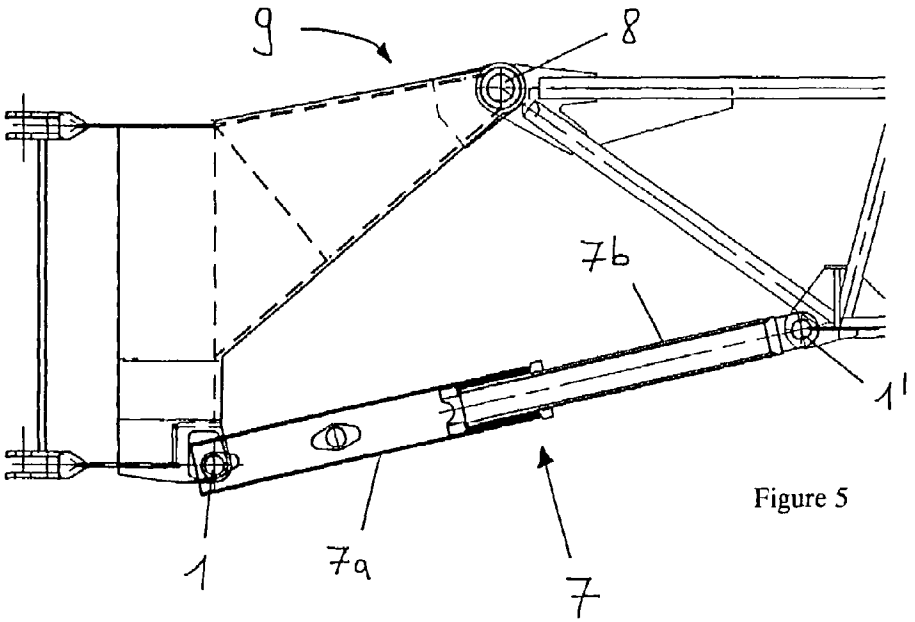

In FIGS. 4 and 5, the expensive illustration of a bending device comprising a hydraulic cylinder in accordance with the prior art (FIG. 4) is compared with an embodiment in accordance with the invention. FIG. 4 shows the joint area 9' of the folding pinnacle, wherein a hydraulic cylinder 17 is arranged between two joints on the lower side on which there is a pressure load. In order to simplify said—as explained above—expensive and elaborate embodiment, and to provide a cost-effective alternative, a telescopic pipe 7 is then employed in accordance with the invention (FIG. 5) instead of the hydraulic cylinder. All the remaining components of the folding pinnacle and/or the joint area 9 can continue to be used. The upper portion of the folding pinnacle, running to the right-hand side in FIG. 5, pivots about the joint 8, adjusting an angle which is pre-set by the length of the telescopic pipe 7, the base pipe 7*a* and extending piston 7*b* of which are each supported on each other in a particular position once the support elements are introduced (these are explained later), and thus pre-set a certain length and angular position. Furthermore, FIG. 5 also shows how the joint connections 1 and 1' for the telescopic pipe attach at exactly the same points as those of the hydraulic cylinder 17 shown in FIG. 4.

Figure 6:
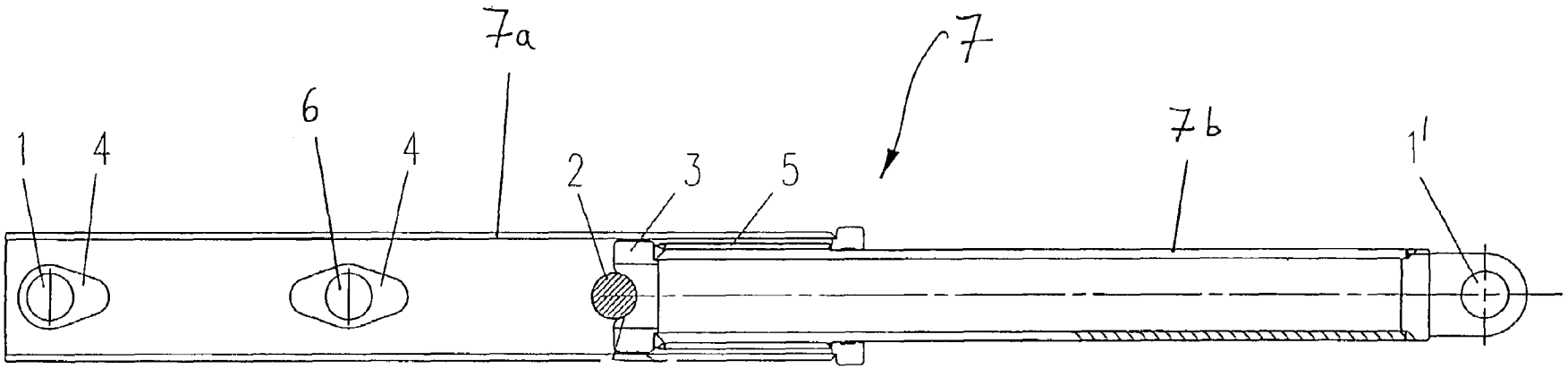
FIGS. 6 to 8 details of the telescopic pipe of the folding pinnacle bending device in accordance with the present invention.
Figure 8:
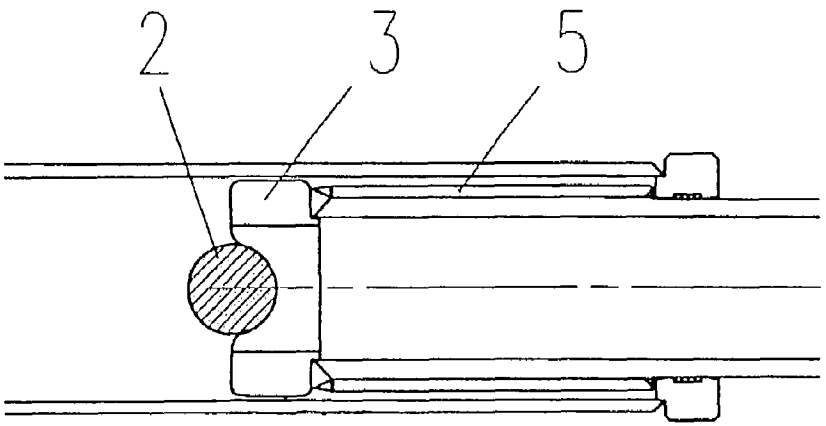
Figure 7:
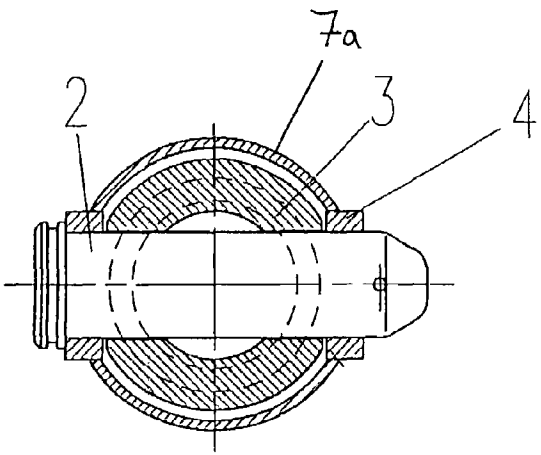

FIGS. 6 to 8 show details of the telescopic pipe 7. The telescopic pipe comprises the base pipe 7*a* and the extending piston 7*b*, which are attached by a joint to the folding pinnacle at the points indicated by 1 and 1', as shown in FIG. 5. The base pipe 7*a* and the extending piston 7*b*, which in this case in also formed as a pipe, can be pre-fabricated completely and then simply inserted into each other. By inserting or omitting bolts, which will be discussed in more detail later, the length of the overall arrangement, i.e. the overall length of the telescopic pipe 7, can be altered.

As also follows from FIG. 7, which shows a cross-section at the point with the bolt 2 in FIG. 6, the base pipe 7*a* comprises transverse bores, one of which is indicated by the reference numeral 6. Supporting bolts 2, one of which is shown in FIG. 6, can be inserted into said transverse bores. These supporting bolts support the lower portion of the piston 7*b* (at different points) at particular lengths for the overall telescopic pipe 7. The base pipe 7*a* does not have to be worked on the inner side. Centring is realised in one axis via the bolt 2 and the fillet or groove in a piston base 3, and in the other axis by the piston 7*b* and the welding hubs provided with the reference numeral 4, such that guiding is independent of the manufacturing tolerances of the pipe. As follows from FIG. 7 in particular, the welding hubs 4 form reinforcements on the rims of the transverse-bores 6, wherein the surface pressure between the bolt 2 and the pipe wall can be reduced by larger sheet thicknesses. The welding hubs 4 thus have two functions, i.e. on the one hand, centring the piston 7*b* in the base pipe 7*a*, and on the other, reinforcing as supporting elements in the area of the transverse-bores.

A particular advantage is that a bolt in the bearing 1 (FIGS. 5 and 6), in addition to its function as a joint bolt, can also be used as a counter bearing (support) for the piston 7*b* when it is inserted. This reduces the dead length and increases the overlap when expelled. The larger overlap has a positive effect on the safety against buckling.

FIGS. 6 and 8 again highlight the distancing sleeve 5 which prevents the telescopic pipe from being pulled apart, such that the folding pinnacle can in no way "tip over" backwards, even when it is not bent. Since the lower opening on the base pipe 7*a* enables the parts 7*a* and 7*b* to be easily inserted into each other, the piston base 3 can be fixedly connected to the piston pipe. This then enables the telescopic pipe 7 to be easily assembled. The piston base 3 can also be configured so as to be detachable.

Figure 9:
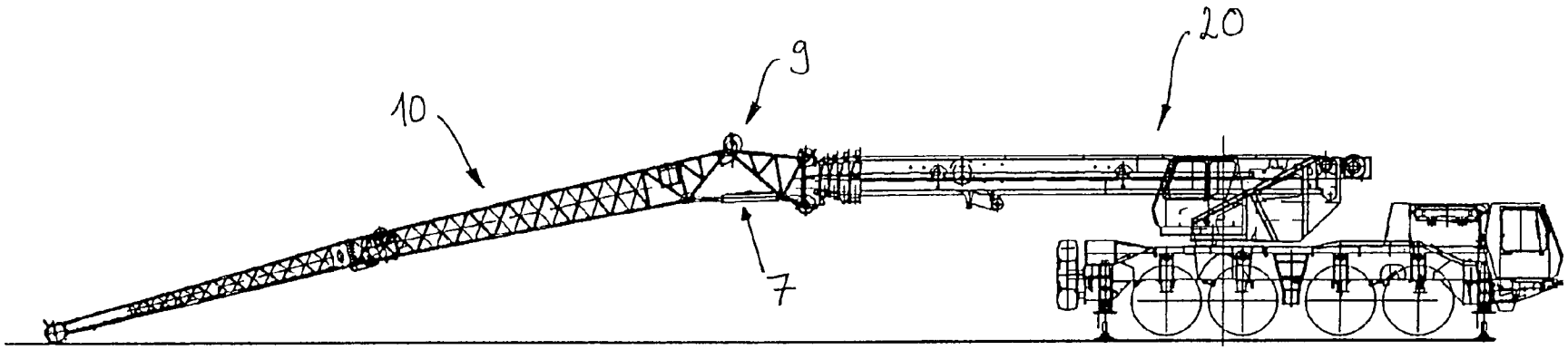
FIGS. 9 and 10 bending the folding pinnacle while raising a jib, comprising a bending device in accordance with the present invention.
Figure 10:
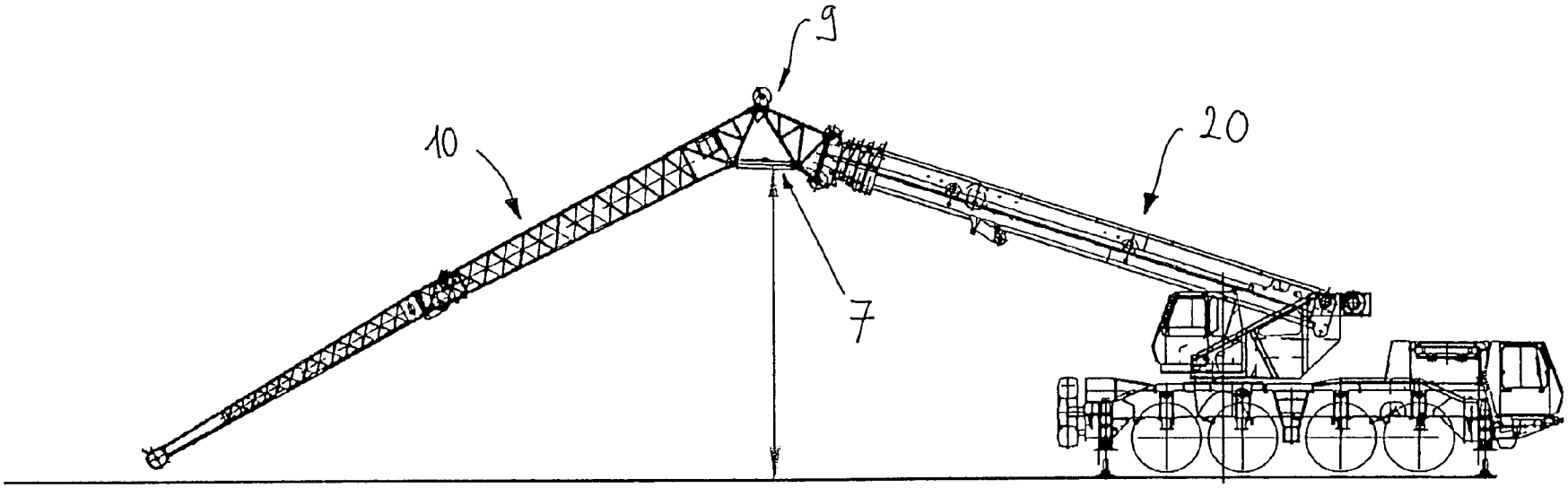

FIGS. 9 and 10 show the jib of a mobile crane 20, including the folding pinnacle 10, being erected. Since the piston 7*b* is only supported on one side on one of the selected or inserted bolts (2 or 1), as shown in FIGS. 5 to 8, the bolts can be set immediately if the crane pinnacle exhibits no bend or only a very small bend, as shown in FIG. 9. In the state shown in FIG. 9, the final angular position can be set at a relatively low height by setting the bolt into the base pipe 7*a* of the telescopic pipe 7 at the desired point. When the jib is then raised, as shown in FIG. 10, the telescopic pipe 7 shortens until the piston 7*b* hits the bolt (2 or 1) and is supported on it. FIG. 10 shows a state in which the shortest length of the telescopic pipe has been selected as the end position, the piston being supported on the joint bolt 1 (see FIG. 6). The jib can then be fully raised, together with the bendable folding pinnacle or level luffing pinnacle 10, and operated safely.

Using the particular construction in accordance with the present invention, it is possible to pre-select the desired angle of the folding pinnacle (length of the telescopic pipe) in the case of a small angle of the main jib. The pinnacle then bends when the main jib is raised, until the telescopic pipe has reached the pre-selected length. It is not necessary to further secure the pinnacle, which enables all assembling work to be performed near the ground. A cost-effective alternative to expensive hydraulic cylinder devices is thus provided by the invention, enabling conveniently assembly on the ground, without the danger of accidents.

The invention claimed is:

1. A folding pinnacle pivoting device for a mobile crane, comprising:

a joint that pivotally connects an end of a folding pinnacle to an end of a boom of the mobile crane, the joint being provided where a tensile load is applied between the folding pinnacle and the boom; and a mechanically adjustable telescoping means that can be adjusted to a plurality of lengths for adjusting an angle of the folding pinnacle with respect to the boom, the mechanically adjustable telescoping means being provided between the end of the folding pinnacle and the end of the boom where a pressure load is applied between the folding pinnacle and the boom, the mechanically adjustable telescoping means being adapted to limit a length thereof to an adjusted length when the pressure load is being applied between the folding pinnacle and the boom and to allow the length thereof to extend freely when no pressure load is being applied.

2. The folding pinnacle pivoting device as set forth in claim 1, wherein said telescoping means comprises a telescopic pipe.

3. The folding pinnacle pivoting device as set forth in claim 2, wherein the telescopic pipe comprises support elements for mechanically altering a length of the telescopic pipe.

4. The folding pinnacle pivoting device as set forth in any one of claim 2 or 3, wherein the telescopic pipe comprises a round or cornered base pipe and an extending piston, wherein said base pipe comprises lateral inserts for guiding said extending piston.

5. The folding pinnacle pivoting device as set forth in claim 4, wherein said lateral inserts form hubs for the transverse bores.

6. The folding pinnacle pivoting device as set forth in claim 2 or 3, wherein the telescopic pipe comprises a holding element and an extending element, and wherein said holding element is fastened by a first joint to an end of the boom facing a base of the folding pinnacle, and said extending element is fastened by a second joint to an end of the folding pinnacle.

7. The folding pinnacle pivoting device as set forth in claim 6, wherein said support elements are arranged on the holding element.

8. The folding pinnacle pivoting device as set forth in claim 6, wherein the first joint forms one of the support devices.

9. The folding pinnacle pivoting device as set forth in claim 6, wherein a piston base is attached to a lower, supporting end of the extending element.

10. The folding pinnacle pivoting device as set forth in claim 9, wherein the piston base has a groove that receives the support element to centre the extending element with respect to the holding element.

11. The folding pinnacle pivoting device as set forth in any one of claims 1, 2, and 3, wherein the telescoping means comprises a round or cornered base pipe and an extending piston, and wherein the base pipe comprises transverse bores for receiving a support bolt which supports said piston at its lower end.

12. The folding pinnacle pivoting device as set forth in claim 1, wherein the telescoping means comprises a securing device which prevents its telescopic components from detaching from each other.

13. The folding pinnacle pivoting device as set forth in claim 12, wherein the securing device is a distancing sleeve provided between a lower, supporting end of the extending element and an upper end of the holding element.

14. The folding pinnacle pivoting device as set forth in claim 1, wherein the telescoping means comprises a support element for mechanically fixing the length of the telescoping means at different lengths.

15. The folding pinnacle pivoting device as set forth in claim 1, wherein the telescoping means comprises a holding element and an extending element, and wherein said holding element is fastened by a first joint to an end of the boom facing a base of the folding pinnacle, and said extending element is fastened by a second joint to an end of the folding pinnacle.

* * * * *